US007146662B1

(12) United States Patent
Pollard et al.

(10) Patent No.: US 7,146,662 B1
(45) Date of Patent: Dec. 12, 2006

(54) SELF-LEVELING BED SUPPORT FRAME

(76) Inventors: Michael H Pollard, Route 1, Box 931, Griffithsville, WV (US) 25521; Michael H Pollard, Jr., 118 W. Plum St., Chesterfield, IN (US) 46017

( * ) Notice: Subject to any disclaimer, the term of this patent is extended or adjusted under 35 U.S.C. 154(b) by 0 days.

(21) Appl. No.: 11/226,018

(22) Filed: Sep. 14, 2005

(51) Int. Cl.
*A47B 7/02* (2006.01)

(52) U.S. Cl. ..... 5/617; 5/118; 5/634

(58) Field of Classification Search ..... 5/118, 5/424, 617, 634; 296/190.02; 114/191–193
See application file for complete search history.

(56) References Cited

U.S. PATENT DOCUMENTS

| | | | | | |
|---|---|---|---|---|---|
| 2,575,189 | A | * | 11/1951 | Schmidt | 5/11 |
| 3,247,528 | A | * | 4/1966 | Swenson et al. | 5/658 |
| 3,299,447 | A | | 1/1967 | Dome | |
| 3,371,359 | A | | 3/1968 | Dome | |
| 3,588,500 | A | * | 6/1971 | Koerner | 5/601 |
| 3,612,599 | A | | 10/1971 | Sternberg | |
| 3,760,436 | A | | 9/1973 | Zach, et al. | |
| 3,921,951 | A | | 11/1975 | Blok | |
| 4,144,601 | A | * | 3/1979 | Anderson et al. | 5/118 |
| 4,196,483 | A | * | 4/1980 | Lefler et al. | 5/118 |
| 4,309,783 | A | | 1/1982 | Cammack et al. | |
| 4,497,078 | A | * | 2/1985 | Vogel et al. | 5/118 |
| 4,625,348 | A | | 12/1986 | Renggli et al. | |
| 4,713,851 | A | * | 12/1987 | Rosquist | 5/118 |
| 4,768,242 | A | * | 9/1988 | LoTurco | 5/93.1 |
| 4,935,968 | A | * | 6/1990 | Hunt et al. | 5/713 |
| 4,979,248 | A | | 12/1990 | Kelley | |
| 4,989,281 | A | * | 2/1991 | Christensen | 5/118 |
| 5,095,560 | A | * | 3/1992 | Volker | 5/11 |
| 5,141,201 | A | | 8/1992 | Mizuno et al. | |
| 5,218,728 | A | * | 6/1993 | Lloyd et al. | 5/118 |
| 5,285,995 | A | * | 2/1994 | Gonzalez et al. | 248/550 |
| 5,638,560 | A | * | 6/1997 | Rigdon et al. | 5/118 |
| 5,822,813 | A | * | 10/1998 | Powell | 5/118 |
| 5,829,077 | A | | 11/1998 | Neige | |
| 5,848,450 | A | * | 12/1998 | Oexman et al. | 5/713 |
| 6,263,527 | B1 | * | 7/2001 | Ross et al. | 5/118 |
| 6,505,363 | B1 | * | 1/2003 | Davis | 5/118 |
| 6,568,008 | B1 | * | 5/2003 | Siepmann et al. | 5/617 |
| 6,615,429 | B1 | * | 9/2003 | Weil et al. | 5/601 |
| 6,671,900 | B1 | * | 1/2004 | Davis | 5/118 |
| 6,671,901 | B1 | * | 1/2004 | Zenczykowski | 5/118 |

(Continued)

*Primary Examiner*—Patricia Engle
*Assistant Examiner*—Jonathan Liu
(74) *Attorney, Agent, or Firm*—John J. Giblin, Jr.; Bowles Rice McDavid Graff & Love LLP

(57) ABSTRACT

A self-leveling bed support frame provides an automatically-controlled level sleeping surface in the sleeper cab of a semi-trailer rig. The self-leveling bed support frame is comprised first of a rectangular lower frame with four pneumatic actuators in each corner. A rectangular upper frame is above the lower frame and engages at its corners with the pneumatic actuators. An automatic control system operates the four pneumatic actuators to maintain a level upper frame by utilizing two pair of mercury switches disposed on two independent control axes. Each pair of mercury switches control the positioning of a pair of the pneumatic actuators, disposed at either end of a diagonal across the upper frame. An adjustable seat back assembly is also provided which can elevate one end of a mattress on the upper frame, using a pair of scissor jack mechanisms, which provide fine control when utilized with a pneumatically controlled actuator.

7 Claims, 6 Drawing Sheets

U.S. PATENT DOCUMENTS 6,718,574 B1 * 4/2004 Bradley et al. ..... 5/118

6,993,798 B1 * 2/2006 Roberts ..... 5/118

* cited by examiner

SELF-LEVELING BED SUPPORT FRAME

BACKGROUND OF THE INVENTION

1. Field of the Invention

The present invention relates to an adjustable, self-leveling bed frame useful for installation in the sleeper compartments of truck tractors.

2. Description of the Prior Art

Across the United States of American, as well as other nations, much of the goods of commerce are transported by trucking rigs called semi-tractor trailers. These trucking rigs are comprised of a combination of an enclosed un-powered trailer, with one or more rear axles and a forward hitch, and a powered, tractor occupied by the driver and other passengers which pulls the trailer across the roadway. These semi-tractor trailer rigs are capable of hauling up to 20 tons of cargo for long distances over a nation's roads and highways.

During long-distance haulage, drivers often have difficulty finding sleeping facilities. To this end, many tractor cabs are equipped with sleeper compartments with a built-in bed frame and mattress, allowing the driver to sleep within the cab. The bed frame is typically mounted transversely and located behind the driver's and passenger's seats. This sleeper compartment can be conveniently used by a driver after parking the rig at a rest stop, many of which have been constructed on the interstate highway system. But, in the vast undeveloped expanses of the American West, rest stops or adequate hotel or motel facilities may be hundreds of miles apart, often necessitating a driver to pull off roadway to rest and sleep instead of risking the potential hazard of falling asleep during the hours needed to reach the next location for comfortable sleep. However, highways and roadways are typically constructed with a crown, in which the roadway, in lateral cross-section, is highest in the middle and slopes downward towards either shoulder or side. This crown, along with any slope in the roadway, places the cot at an angle from horizontal, which for many people interferes with a restful sleep.

Alternatively, these semi-tractor trailers equipped with sleeper compartments may be driven by a team of two drivers, who alternate in driving the rig. While one is driving the other is resting or sleeping. This scheme permits the rig to operate nearly continuously, thereby reducing overall shipping time and labor costs. While operating in this manner, one driver would drive the rig, and the other would sleep, either in the passenger seat or in the sleeper compartment, if so provided. However, the vibrations as well as the slope and crown of the roadway interfere with a restful sleep.

A bed frame is desirable which can mount within a sleeper compartment of a semi-tractor trailer rig, which can absorb road vibration and can adjust for the pitch and roll from the slope and crown of the roadway. Several attempts have been made in the prior art to address these problems. For example, Davis, U.S. Pat. No. 6,671,900, teaches of a bed leveler/adjuster which provides a bed frame which is comprised of two end sections which pivot at a middle section. The middle section may be vertically elevated, and either end section can be pivoted relative to the middle section. This provides a means for inclining the bed frame, either at the foot or at the head, to compensate for lateral cant in a tractor parked on the shoulder or edge of a road. The head or foot of the frame may be further inclined relative to the other frame section to provide for more comfort. However, it cannot compensate for any longitudinal pitch of the cab when the rig is parked on a sloped roadway. Under such circumstances, a person using a bed frame as taught in Davis might still experience discomfort from rolling, or the sensation of rolling, out of the bed frame.

In Renggli et al., U.S. Pat. No. 4,625,348, a mechanism for inclining a bed frame is disclosed. However, the entire frame remains in a constant plane, the head or foot ends cannot be inclined relative to the other end for further comfort. In addition, it cannot be canted laterally.

Anderson et al., U.S. Pat. No. 4,144,601; Dome, U.S. Pat. No. 3,299,447, Vogel et al., U.S. Pat. No. 4,497,078; Zach et al., U.S. Pat. No. 3,760,436 and Lefler et al., U.S. Pat. No. 4,196,483, all teach of bed frames for a tractor cab which provide means for isolating the bed frame from road vibration, but which do not provide any means for longitudinally inclining or laterally canting the frame to compensate for crown or slope in the roadway. The inventions disclosed in these patents are uniquely suited only for berthing while the tractor cab is in motion, and would not provide needed comfort when the cab was parked on the shoulder of a roadway.

A sleeper bed frame which can mount in a sleeper section of a tractor cab and which can be inclined longitudinally and canted laterally, which isolates roadway vibration and which has an end section which can be further tilted relative to the other end section is desirable.

SUMMARY OF THE INVENTION

The present invention relates to a bed support for installation in the sleeper compartment of the cab of a semi-tractor trailer rig. The frame provides the capability of inclining or tilting in both horizontal axes, both longitudinally and laterally. With inclination control in both horizontal axes, a level sleeping surface may be provided regardless of the orientation of the tractor cab. It further provides an independent head section which inclines at a different angle relative to the remainder of the bed frame, providing additional comfort where desired. The present invention also provides vibration isolation from a semi-tractor trailer rig traveling along a roadway.

The bed support frame is comprised of two frames, and upper and a lower frame. The lower frame is a rectilinear frame structure made of structural members. It is rigidly fastened to the floor of the sleeper compartment of the tractor cab or, preferably, to the existing bed frame provided by the truck manufacturer. Mounted at each of the four corners of the lower frame is a pneumatic actuator. Above the lower frame and the four pneumatic actuators is an upper frame, rectilinear in shape and having four corners, one each of which is mounted to an extendable member of one of the four pneumatic actuators. The upper frame further has an included head section, which is mounted in one half of the upper frame and which can pivot on a horizontal axis, disposed near the middle of the upper frame.

A mattress is disposed on the top of the upper frame. By providing and controlling air pressure to the four pneumatic actuators separately, each of the four corners of the upper frame may be adjusted vertically of the others, thereby maintaining a level mattress surface in both horizontal axes. The inserted head section may be further inclined relative to the upper frame, thereby providing further comfort as desired.

The invention further provides either a manual or an automatic system for controlling air pressure to the four pneumatic actuators, which will quickly and effortlessly level the upper bed frame without manual effort, and which will maintain a level bed frame even if the tractor cab is in motion over graded, sloping highway surfaces.

One object of this invention is to provide an adjustable bed support frame for a tractor cab sleeper compartment.

Another object is to provide an adjustable bed support frame that may be adjusted over both horizontal axes to maintain a level surface.

Another object is to provide an adjustable bed support frame that further provides means for inclining the head of a mattress thereon relative to the foot of the mattress and the remainder of the bed frame.

Another object is to provide an adjustable bed support frame having means for automatically adjusting and maintaining a level surface for a mattress.

Another object is to provide an adjustable bed support frame having means for manually adjusting and maintaining the attitude of each corner of the frame independently.

These and other objectives and advantages of the invention will become apparent from the description which follows. In the description, reference is made to the accompanying drawings, which from a part hereof, and in which is shown by way of illustration specific embodiments in which the invention may be protected. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

DETAILED DESCRIPTION OF THE PREFERRED EMBODIMENT

The following discussion describes in detail one or more embodiments of the invention. The discussion should not be construed, however, as limiting the invention to those particular embodiments, and practitioners skilled in the art will recognize numerous other embodiments as well. The complete scope of the invention is defined in the claims appended hereto.

Figure 1:
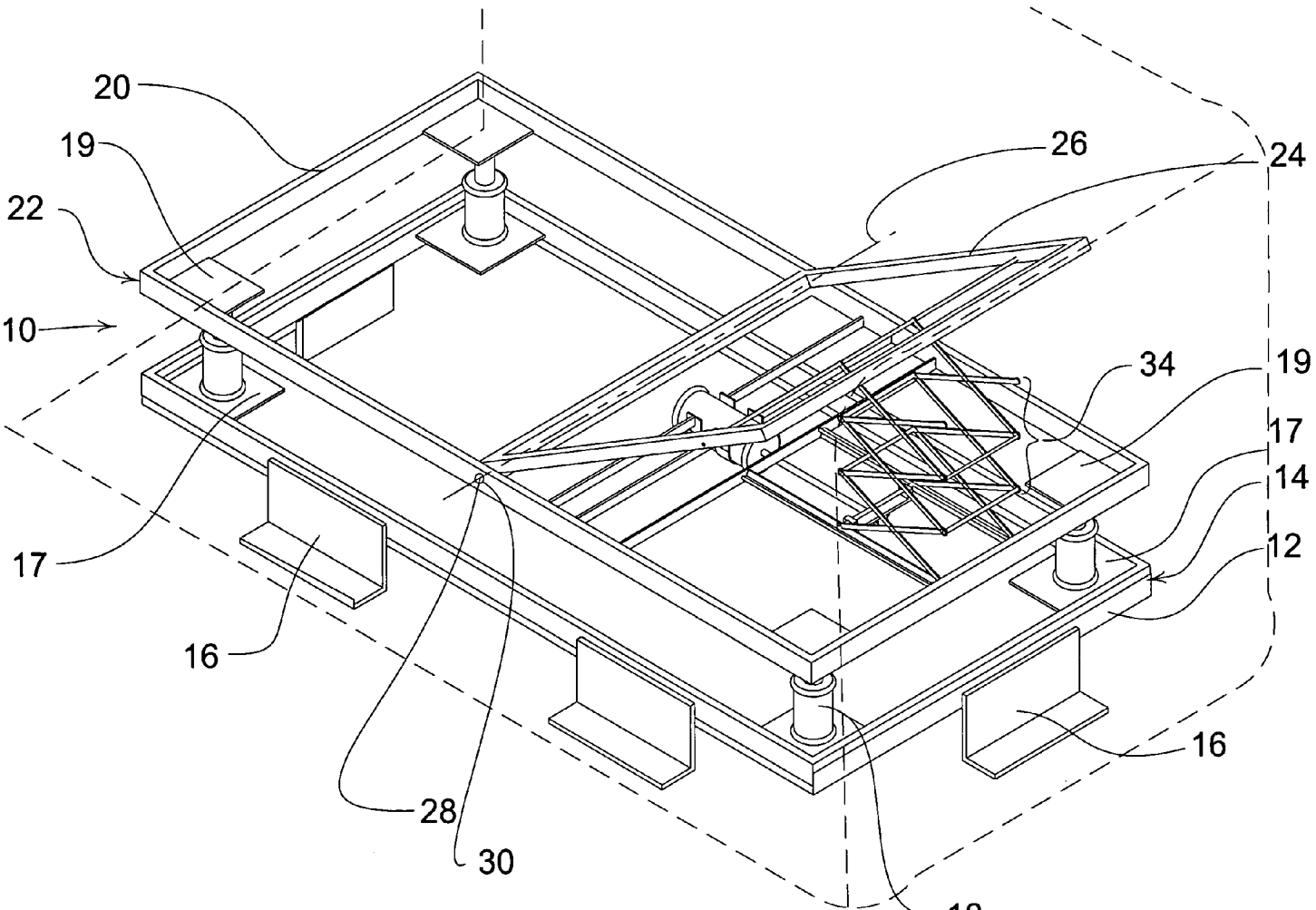
FIG. 1 is an isometric view of the self-leveling bed support frame.
Figure 2:
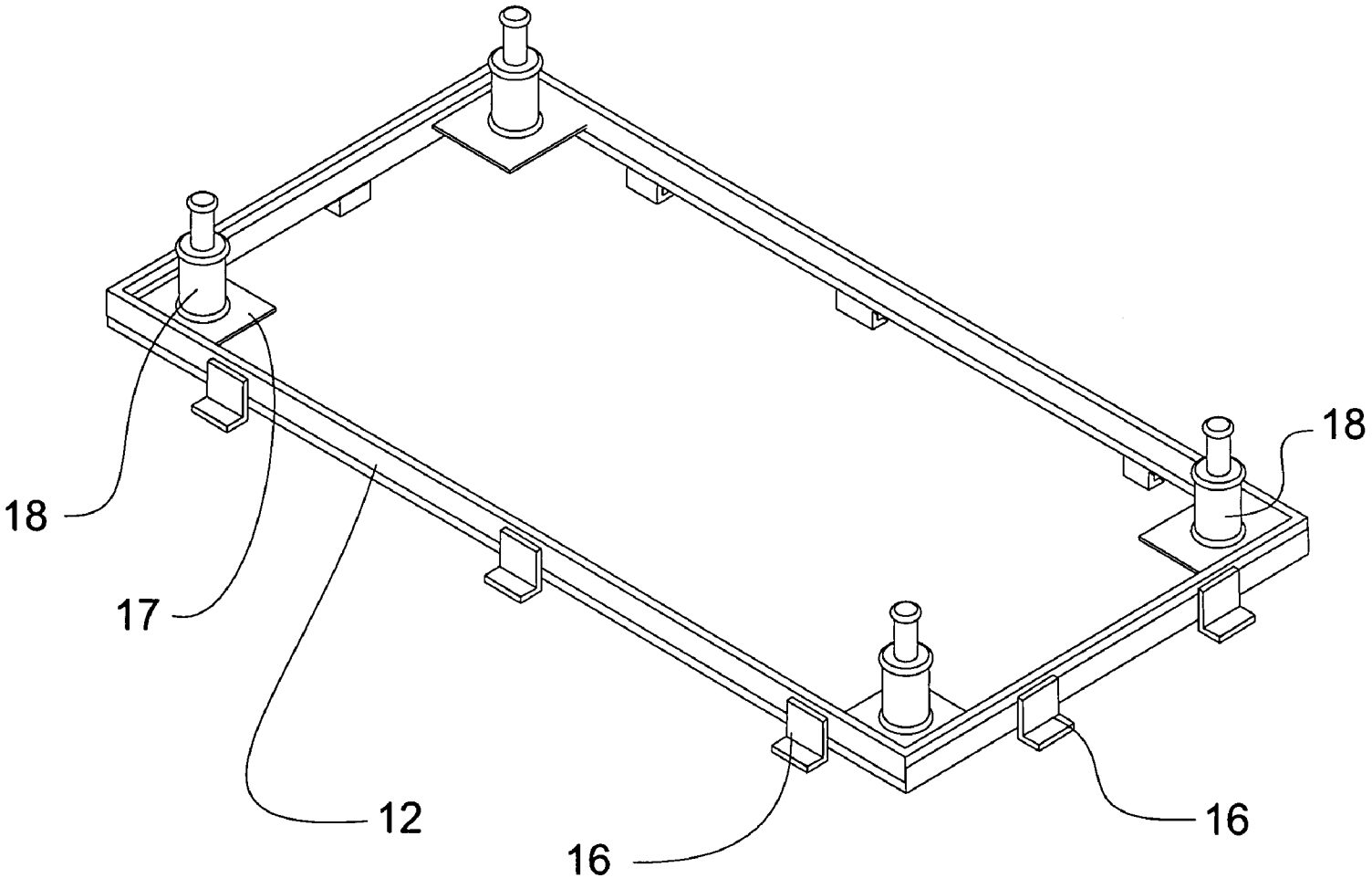
FIG. 2 is an isometric view showing the lower frame and pneumatic actuators.

As shown in FIG. 1, a self-leveling bed support frame, which is generally designated in the drawings as reference no. 10, is comprised in part of a lower frame 12. As shown as well in FIG. 2, the lower frame 12 is a rectilinear frame fabricated from of structural members, preferably tubular steel structural members, or the like. A number of first mounting brackets 16 are attached to the lower frame 12, which provides means for mounting the lower frame 12 rigidly to the floor body of the sleeper compartment of a tractor cab or to the existing bed frame typically provided by the truck manufacturer. Each first mounting bracket 16 typically is a short section of an angle or "L" bar, with two webs orthogonal to each other. One web is mounted to a member of the lower frame 12, by bolts, welding or other fastening methods well known in the applicable art. The other web, which is parallel to the plane of the lower frame 12, mounts to the floor of the sleeper compartment of the tractor cab. This would typically be accomplished with bolts through holes drilled or stamped in both the second web of the first mounting bracket 16 and in the floor of the sleeper cab. The location, dimensions, and number of first mounting brackets 16 will vary depending on the design of the sleeper compartment or existing bed frame to which the lower frame 12 is being mounted. The plane of the lower frame 12 should generally be parallel to the overall plane of the floor of the sleeper compartment, with the edges of the lower frame 12 spaced sufficiently far from the walls of the sleeper compartment to allow movement of the bed frame mechanisms and to manually reach around the self-leveling bed support frame 10 to access components.

In each of the four corners 14 of the lower frame 12 is a second mounting bracket 17. The second mounting bracket 17 provides a mounting surface upon which a pneumatic actuator 18 is disposed. As used herein, a pneumatic actuator encompasses a kind of apparatus having an extendable member which may pneumatically extend, contract and exert a force along a longitudinal axis. This type includes an apparatus having a cylinder with an internal bore, and a piston registering with the internal bore of the cylinder, wherein the piston is extended by applying compressed air to the interior bore of the cylinder, forcing the piston outward along the longitudinal axis of the cylinder bore. It also includes, in the preferred embodiment, a hollow closed tube fabricated of a tough but flexible material which corrugates longitudinally in its unloaded or unpressurized state and extends when the internal portion of the tube is pressurized by compressed air. When air pressure is released from the tubular body of this type actuator, the cylindrical wall corrugates and the longitudinal length of the tubular body retracts. This type is found in vehicle suspension systems and is commonly referred to as an air spring. One supplier of this type pneumatic actuator is Air Ride Technologies, Inc.

One of the pneumatic actuators 18 is mounted in each of the four corners 14 of the lower frame 12 such that the longitudinal axis of each extendable member in the pneumatic actuators 18 are parallel to each other and orthogonal to the plane of the lower frame 12. The design of each second mounting bracket 19 will vary dependant upon the design and configuration of the mounting means provided on the particular model of pneumatic actuators 18 selected to achieve the desired orientation of the installed pneumatic actuator 18.

An upper frame 20 is disposed above the lower frame 12. The upper frame 20 is likewise rectangular in overall shape, with four corners 22, and fabricated from tubular metal structural members, or the like, typically of a rectangular cross-section using fastening methods known in the art. At each of these four corners 22 is a third mounting bracket 19, for attaching the upper frame 20 to the top of the pneumatic actuator. Again, the design of the third mounting bracket 19 will vary dependant upon the design of the pneumatic actuator. The top of the extendible member usually must articulate with the mounting bracket 19 to a limited extent, as the angle between the two will vary slightly as the attitude of the upper frame 20 is adjusted.

Figure 3:
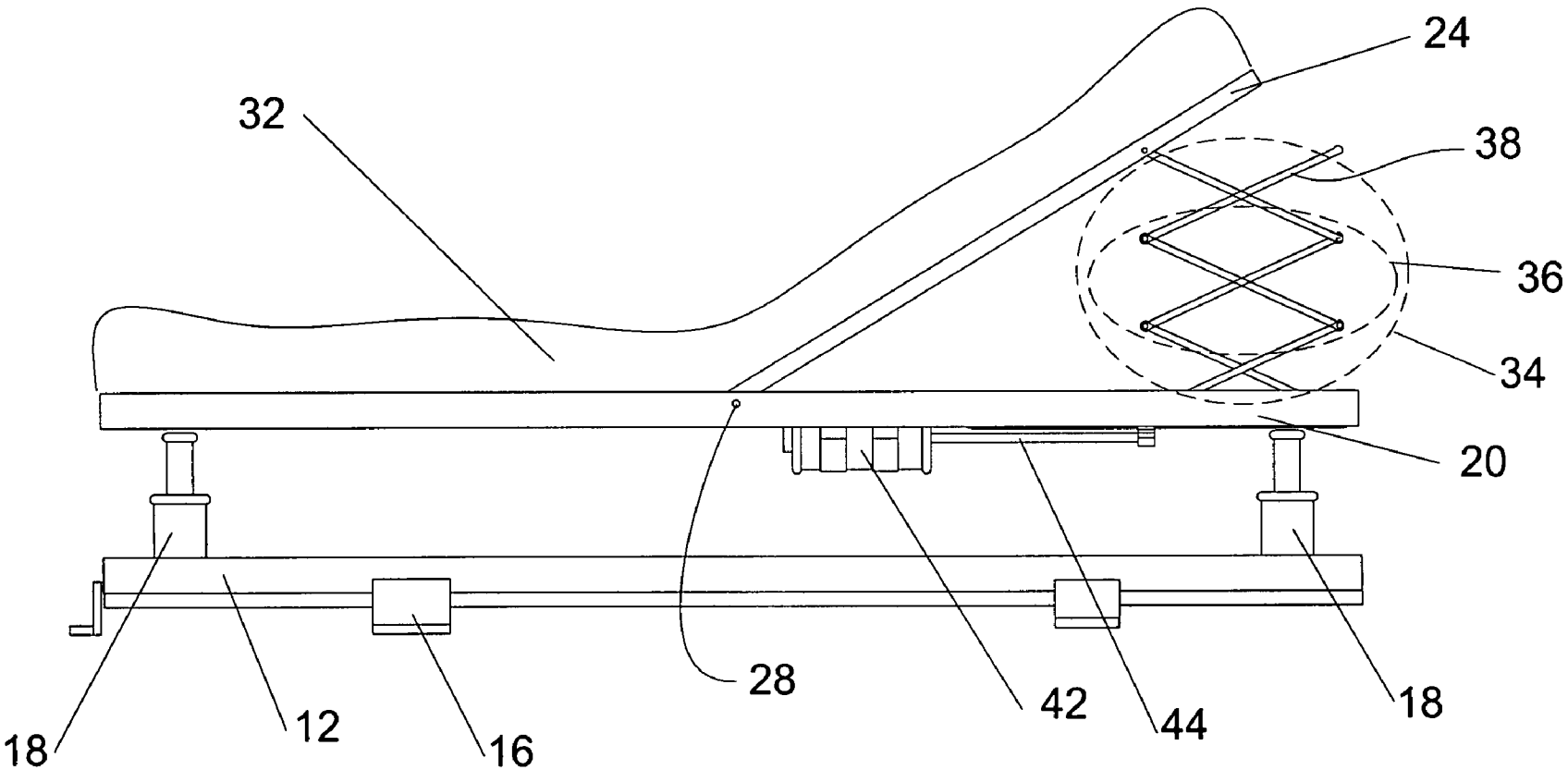
FIG. 3 is a front elevational view of the self-leveling bed support frame.

A seat back assembly 24 is disposed within the upper frame 20. As shown in FIG. 3, the seat back assembly 24 inclines approximately one-half of the mattress 32 which is set upon the upper frame 20. The seat back assembly 24 elevates the normally-head-end of the mattress 32 allowing the occupant of the bed to read, watch television, or other similar activities before fully reclining the mattress 32 to sleep. The seat back assembly 24 is also a rectilinear frame fabricated from tubular steel structural members, or the like, using fastening methods known in the art. The overall width of the seat back assembly 24 is slightly less that the interior width of the upper frame 20, allowing the seat back assembly 24 to nest within the upper frame 20, thereby presenting a continuous plane across the top surfaces of the upper frame 20 and seat back assembly 24 upon which a mattress 32 may rest. The length of the seat back assembly 24 is no more than half the length of the interior of the upper frame 20. The seat back assembly 24 is disposed within the anterior end of the upper frame 20, that is, at the end of the upper frame 20 associated with the head of the bed, or where the head of an occupant of the bed would be situate. At either corner of the posterior end of the seat back assembly 24, i.e., the side parallel and proximate to the lateral midline of the upper frame 20, is a pivot pin 28 extending laterally outward from the seat back assembly 24 and articulating with a pivot socket 30 disposed in the upper frame 20. This permits the seat back assembly 24 to articulate about a pivot axis 26 extending through the two pivot pins 28. The pivot axis 26 would thus be disposed proximate and parallel to the lateral centerline, or minor centerline of the upper frame 20. This articulation would be disposed near the waist or hips of an occupant of a mattress 32 mounted on the upper frame 20.

Figure 4:
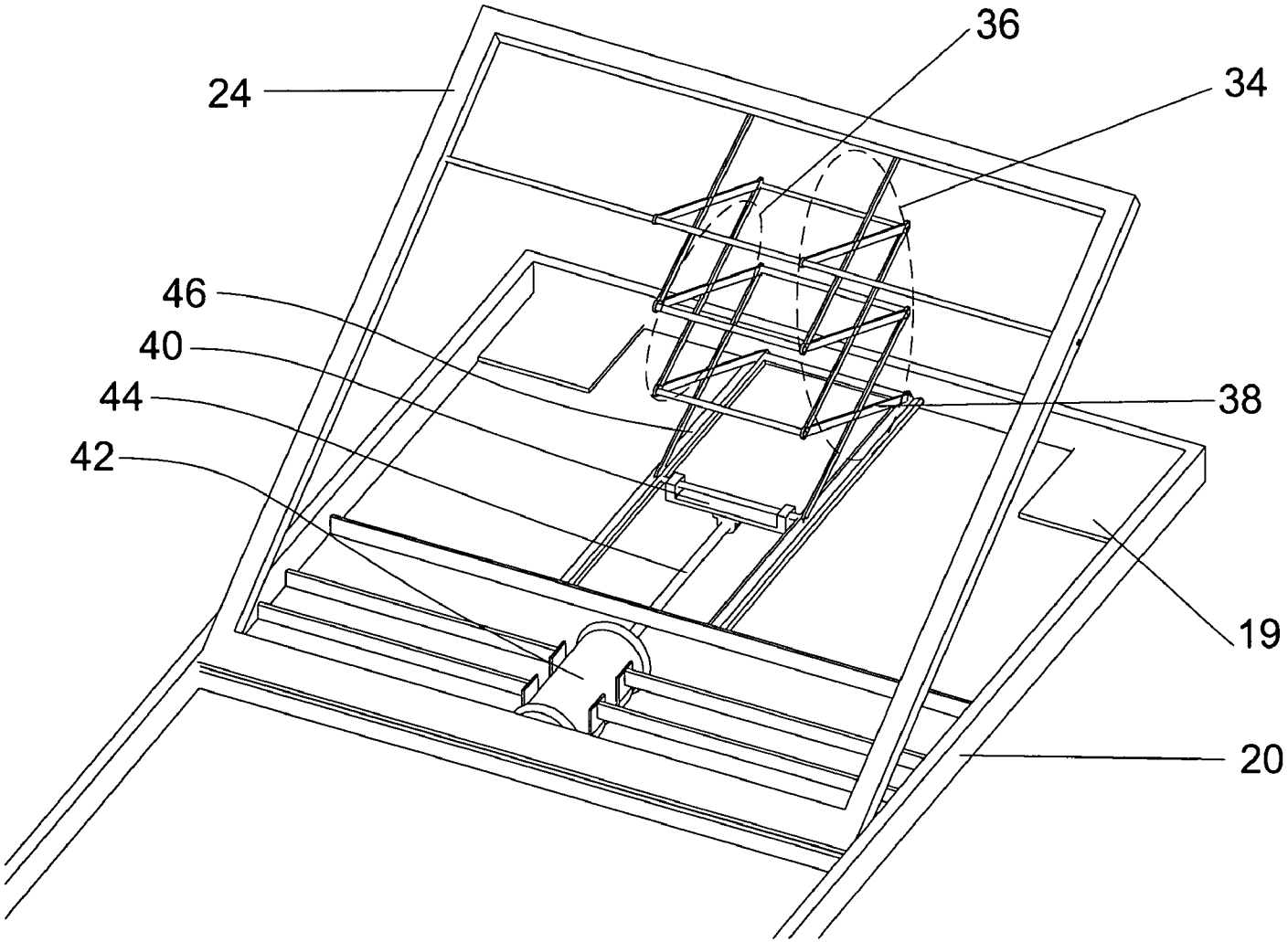
FIG. 4 is an isometric view of the seat back assembly and left jack assemblies.

The anterior end of the seat back assembly 24 is supported by two lift jack assemblies 34, arranged laterally under the seat back assembly 24. As best shown in FIG. 4, each of the lift jack assemblies 34, in the preferred embodiment, is comprised of a series of scissors assemblies 36, each scissors assembly 36 comprised of two elongated members 38 articulating at their centers, and articulating at either end of each elongated member 38 with an end of an elongated member 38 of the adjacent scissor assembly 36. The lift jack assemblies 34 have at least one scissors assembly 36, and have three scissors assemblies 36 in the preferred embodiment. At the top of the lift jack assembly 34, the upper end of one of the two elongated members 38 of each top scissors assembly 36 articulates with one corner of the anterior end of the seat back assembly 24. The upper half of the other elongated member 38 of the top scissors assembly 36 may be removed.

At the lower end of each lift jack assembly 34, the lower ends of one of the elongated members 38 in the bottom scissors assembly 36 articulates with the anterior side of the upper frame 20. The lower ends of the other elongated members 38 of the bottom scissors assemblies 36 of each lift jack assembly 34 in the two lowest scissors assemblies 36 in either lift jack assembly 34 articulate with either end of a crossbar 40. The crossbar 40 is an elongated structural member extending horizontally between the two lift jack assemblies 34 and adducts and abducts the two elongated members 38. By traversing the crossbar 40 towards the anterior end of the upper frame 20, the lower ends of the two elongated members 38 of the lowest scissors assembly 36 are adducted, thereby elongating the scissors assembly 36 and likewise adducting the elongate members 38 and elongating the next scissors assembly 36, and so on, causing the overall lift jack assembly 34 to extend by pivoting the seat back assembly 24 about the pivot axis 26 as shown in FIG. 1. Likewise, traversing the crossbar 40 towards the posterior end of the upper frame 20 abducts the two members of each scissors assembly 36, distending each scissors assembly 36 and each lift jack assembly 34 overall, thereby lowering the seat back assembly 24.

The size and number of scissors assemblies 36 is specified to provide lift jack assemblies 34 which can articulate the seat back assembly 24 to the desired maximum angle, which preferably is at least 45 degrees from horizontal.

The crossbar 40 commutes horizontally by means of a linear actuator 42. The preferred linear actuator 42 is the same type air spring used as the pneumatic actuators 18 supporting the upper frame, or may be a pneumatically powered cylinder and piston. It any case, it similarly has an extendable end 44, which traverses linearly 42. The extendable end 44 of the linear actuator 42 articulates with the longitudinal center of the crossbar 40. The crossbar 40 commutes across a distance slightly less that the length of the elongated members 38 in the scissors assemblies 36, and the linear actuator 42 is sized accordingly.

The linear actuator 42 is mounted to the upper frame 20 using additional structural members, as necessary. A controllable source of pneumatic pressure is provided to the linear actuator 42, as specified by the manufacturer of the actuator.

The bottom end of the scissors assemblies 36 are set within two horizontal tracks 46 which restrict the lateral and vertical motion of the elongated member ends 38 and result in smooth translation of the ends in the horizontal direction.

In use, the self-leveling bed support frame 10 provides a horizontal, level for a mattress surface 32 in a pitched or canted sleeping compartment by adjusting the attitude of the upper frame 20 relative to the lower frame 12 using the four pneumatic actuators 18. Air pressure is applied to or released from each pneumatic actuator 18 in each of the four corners 22 to adjust the pitch or incline of the upper frame 20 in both horizontal axes, both longitudinally and laterally. Air pressure may be controlled manually, or in the preferred embodiment, automatically by a system which senses the attitude of the upper frame 20 and adjusts air pressure to the four pneumatic actuators 18 accordingly, thereby extending or retracting the extendable member in each pneumatic actuator 18 to raise or lower each corner 22 of the upper frame.

Any control system of the air pressure to the four pneumatic actuators 18 must be carefully balanced. The upper surface of the upper frame 20 is a plane, and a plane is defined, geometrically, by three points. In controlling four points, i.e., the positions of the four extendable members, only three may be controlled independently; a fourth must be dependant on the other three. Otherwise an over-constrained system may result which could cause warpage and convex curvature to the upper frame 20.

Figure 5:
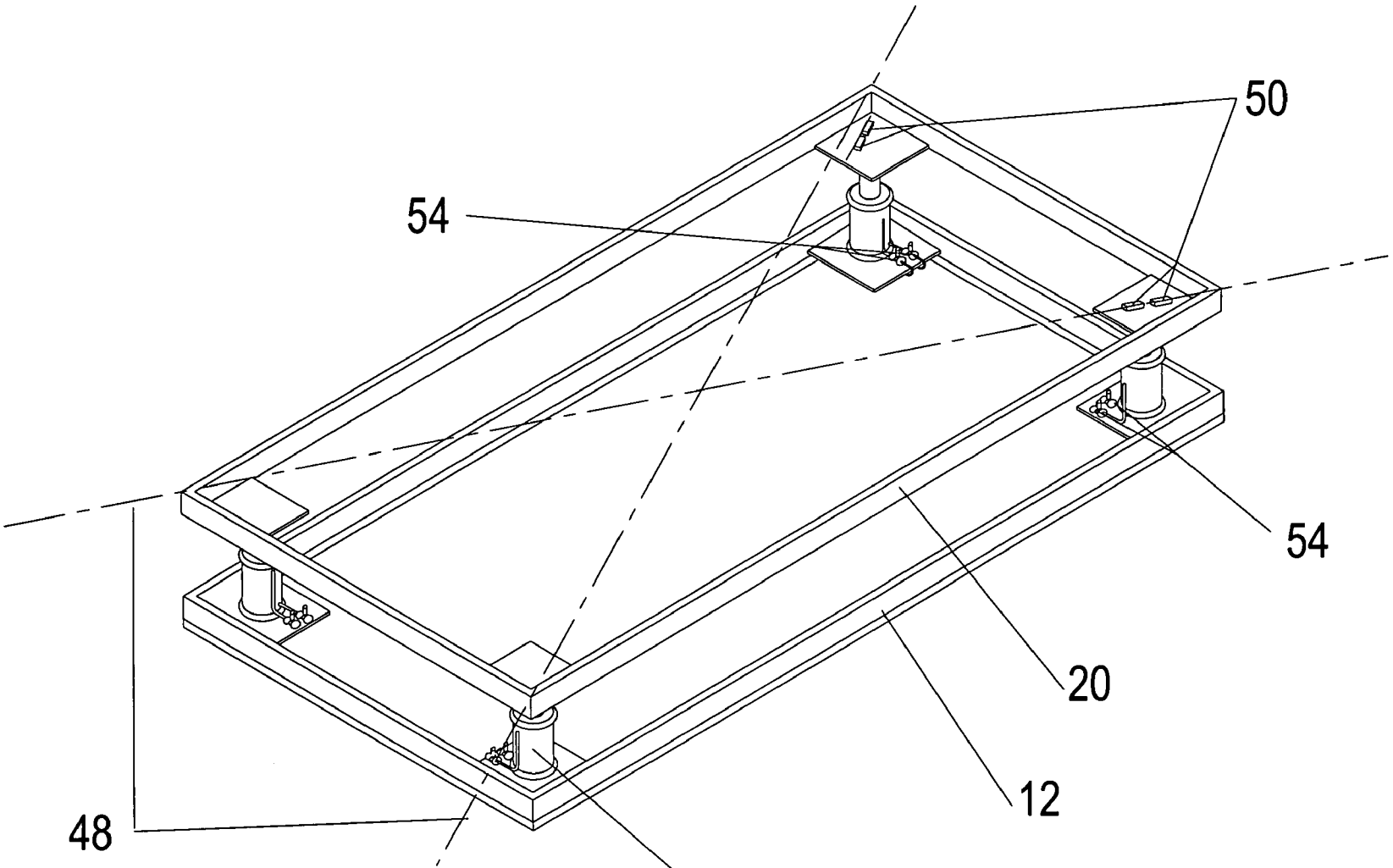
FIG. 5 is an isometric view illustrating the principles of level control system.
Figure 6:
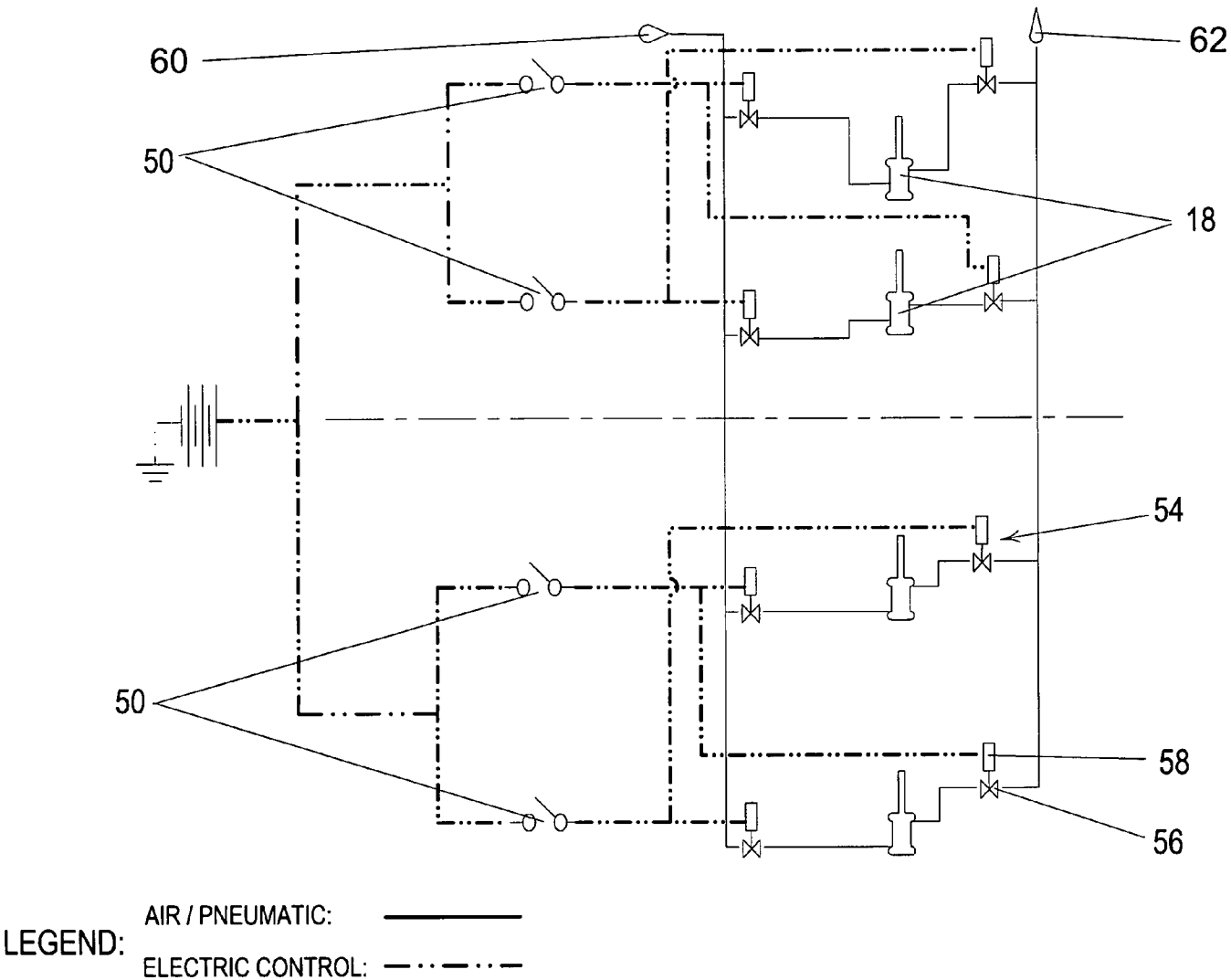
FIG. 6 is a schematic of the automatic level control system.

In the preferred embodiment of the invention, an automatic control system is provided wherein the four pneumatic actuators 18 are controlled as two pairs. As shown in FIGS. 5 and 6, the control system is comprised of four mercury switches 50 and eight solenoid valves 54. The mercury switches 50 and solenoid valves 54, together with the four pneumatic actuators 18, are organized into a pair of independent level control systems, each level control system comprised of two pneumatic actuators 18, two mercury switches 50 and four solenoid valves 54.

As better shown in FIG. 6, each level control system includes pneumatic actuators 18 located diagonally opposite across the lower frame 12. The two mercury switches 50 are disposed collinearly parallel to a line, referred to herein as a control axis 48, between the centers of the two diagonally opposite pneumatic actuators 18. The two mercury switches 50 are installed inverse to each other on the upper frame 20 parallel to the control axis 48 between the two diagonally opposite pneumatic actuators 18, such that each switch is activated or deactivated inversely of the other when the upper frame 20 is tilted or inclined in opposite directions on an axis orthogonal to the control axis 48.

The other level control system for the other two pneumatic actuators 18 in the other diagonally opposite corners of the bed support frame 10 is similarly designed. The two systems will independently attempt to maintain level about an axis orthogonal to the control axis 48 between the two pneumatic actuators 18 in each level control system. If the upper frame 20 has been inclined or canted due to the slope or crown of the road surface, each control system will sense an incline along its control axis 48, and will operate to level that control axis 48. Once that control axis 48 has achieved level, that control system halts. Concurrently, the other control system operates to achieve level along its control axis 48 between the other two corners, halting when that control axis 48 has been placed level. Once both control axes 48 are level, the plane of the upper frame 20 in which both control axes 48 lie is in turn level.

Each of the mercury switches 50 in each level control system is wired in parallel to the two solenoid valves 54. With reference to FIG. 5, each solenoid valve has an electric solenoid 58 which operates a pneumatic valve 56. An electric solenoid 58 is an electrical motive device in which an actuator is moved when an electrical current is applied to a coil within the electric solenoid 58. The pneumatic valve is a valve, like many commonly available, such as a ball valve, which regulates air pressure from a source connected thereto. The actuator of the solenoid operates the regulating mechanism of the valve. Electrical power to the solenoid 58 is switched by the mercury switch 50, which thereby controls air pressure to the pneumatic actuators 18.

The two solenoid valves 54 are installed such that, when a mercury switch 50 energizes the two solenoids 58, one solenoid valve 54 supplies air pressure from an air pressure source 60 to the first of the two pneumatic actuators 18 in the level control system and the other solenoid valve 54 relieves or vents pressure from the other pneumatic actuator 18 to an atmospheric vent 62. The two other solenoid valves 54 in the other actuator system 52 (connected to the other mercury switch 50 of the same control system) pneumatically communicate with the same two pneumatic actuators 18 inversely from the first mercury switch 52—when the second mercury switch 50 energizes, one solenoid valve 54 supplies pressure to the second pneumatic actuator 18 while the other solenoid valve 54 vents or relieves pressure from the first pneumatic actuator 18.

Each opposing pair of mercury switches 52 are in pneumatic communication by the four solenoid valves with the same two pneumatic actuators 18 on either end of one of the two diagonal control axes 48. Each mercury switch 50 is designed, when energized, to pressurize one pneumatic actuator 18 and relieve pressure from the other. However, each mercury switch 50 in a pair controls pressure to the two pneumatic actuators 18 in reverse from the other mercury switch. One mercury switch 50 in a pair will, when energized, supply pressure to the first pneumatic actuator 18 and release pressure from the second pneumatic actuator 18, while the other mercury switch 50 of the pair will, when energized, supply pressure to the second pneumatic actuator 18 and release pressure from the first pneumatic actuator 18.

By arranging the four pneumatic actuators 18 into a pair of level control systems, each system controlling a pair of pneumatic actuators 18 along the control axis 48, i.e., the line between the two diagonal pneumatic actuators 18, one degree of freedom is eliminated. Movement of each pneumatic actuator 18 is dependent upon and proportionally opposite to the movement of another pneumatic actuator 18, thereby maintaining all four corners 22 of the upper frame within one plane.

While various embodiments of the invention have been described above, it should be understood that they have been presented by way of example, and not limitation. It will be apparent to persons skilled in the relevant art that various changes in form and detail may be made therein without departing from the spirit, and scope and application of the invention. This is especially true in light of technology and terms within the relevant art that may be later developed. Thus, the present invention should not be limited by any of the above-described exemplary embodiments, but should only be defined in accordance with the appended claims and their equivalents.

We claim:

1. A self-leveling bed support frame, comprising:

a) a lower frame, having a planar, rectilinear shape with four corners;

b) a pneumatic actuator disposed at each corner of the lower frame, each of said pneumatic actuators having extension means, said extension means having an upper end, in which the axis of extension of all four extension means are parallel;

c) a rectilinear, planar upper frame, with four corners, wherein the upper ends of each extension means of the pneumatic actuators engages with one of the four corners of the upper frame;

d) a seat back assembly comprising a rectilinear frame, wherein said seat back assembly articulates with the upper frame, wherein the seat back assembly articulates about an axis, said axis disposed parallel and proximate to one end of said seat back assembly and parallel and proximate to the minor centerline of the upper frame;

e) lifting means comprising a linear actuator for displacing one end of the seat back assembly relative to an end of the upper frame, wherein the lifting means comprises one or more scissors assemblies, each scissors assembly comprising a pair of elongated members, each member having an upper end and a lower end, the two elongated members of each pair articulating at their longitudinal centers, wherein the linear actuator engages with a lower end of one elongated member in each lifting assembly, and wherein an upper end of another elongated member engages with the seat back assembly;

f) a plurality of level sensors disposed along two control axes, said sensors operating when either of said control axes is displaced from level, and g) pneumatic valves, wherein said pneumatic valves are in pneumatic communication with one or more pneumatic actuators and in communication with said level sensors.

2. The self-leveling bed support frame of claim 1, wherein each of the two control axes extends through two diagonally opposite corners of the upper frame, and wherein the level sensors are disposed parallel to and act along one of the control axes.

3. The self-leveling bed support frame of claim 1, wherein the level sensors are comprised of mercury switches.

4. The self-leveling bed support frame of claim 1, wherein two level sensors are disposed along each control axis, wherein either sensor on a control axis is activated by opposing inclinations of the control axis.

5. The self-leveling bed support frame of claim 1, wherein each level sensor on a control axes communicates with a pair of pneumatic actuators, each of said pair of pneumatic actuators having pneumatic communication with either of the pneumatic actuators on the same control axes at either corner of the upper frame.

6. A self-leveling bed support frame, comprising:

a) a rectilinear, planar lower frame having four corners;

b) four extendable pneumatic actuators, one of each disposed at each corner of said lower frame, each pneumatic actuator having extension means capable of extending orthogonally to the plane of the lower frame, and having an upper end, each pneumatic actuator having a supply of pneumatic pressure provided thereto;

c) a rectilinear, planar upper frame having four corners, said corners of the upper frame engaged by the upper end of the pneumatic actuator extension means;

d) a rectilinear, planar seat back assembly, said seat back assembly capable of articulating about an axis parallel and proximate to the minor centerline of the upper frame;

e) a lifting mechanism for articulating the seat back assembly, said lifting mechanism comprising a pair of lift jack assemblies, each lift jack assembly comprising one or more scissor assemblies, each scissor assembly comprising two scissor arms, each scissor arm having an upper end, a center, and a lower end, the two scissors arms of each scissors assembly articulating at either center, further comprising a crossbar engaging a lower end of a scissors arm in either of the lifting mechanisms, further comprising a linear actuator having an extendable end engaging medially with the crossbar; and f) control means for controlling the extension means of the pneumatic actuators to align the plane of upper frame in a level attitude.

7. The self-leveling bed support frame of claim 6, wherein each lift jack assembly is comprised of a series of three or more scissors assemblies, having a top scissor assembly, a bottom scissor assembly, and one or more intermediate scissor assemblies, wherein an end of the crossbar engages a lower end of the bottom scissor assembly, the upper frame engages an upper end of the top scissor assembly and the lower end of each scissor arm in the intermediary and top scissor assemblies articulate with the upper end of a scissor arm in the adjacent scissor assembly.

* * * * *